United States Patent [19]

Newman

[11] Patent Number: 4,918,953

[45] Date of Patent: Apr. 24, 1990

[54] LOCK MECHANISM

[75] Inventor: Donald J. Newman, Somerville, Australia

[73] Assignee: Ogden Industries Pty. Ltd., Huntingdale, Australia

[21] Appl. No.: 304,235

[22] Filed: Jan. 31, 1989

[30] Foreign Application Priority Data

Feb. 1, 1988 [AU] Australia ..... PI 6513

[51] Int. Cl.[5] ..... E05B 63/12

[52] U.S. Cl. ..... 70/131; 70/102

[58] Field of Search ..... 70/131, 134, 102, 129, 70/142; 292/140, 169.17, DIG. 41

[56] References Cited

U.S. PATENT DOCUMENTS

| | | | |
|---|---|---|---|
| 1,373,353 | 3/1921 | Roden | 70/104 |
| 2,666,661 | 1/1954 | Segal | 70/131 |
| 4,719,774 | 1/1988 | Neuman | 70/131 |
| 4,724,691 | 2/1988 | Newman | 70/221 |

*Primary Examiner*—Robert L. Wolfe

*Attorney, Agent, or Firm*—Stevens, Davis, Miller & Mosher

[57] ABSTRACT

A lock bolt mechanism includes a housing on which a lock bolt is mounted for movement between locked and unlocked terminal positions. An inside actuator is rotatably mounted on the housing and a first drive connection links the inside actuator to the lock bolt whereby the lock bolt is caused to move in response to rotation of the inside actuator. An outside actuator is linked to the lock bolt through a second drive connection and is rotatable in order to move the lock bolt. A gear train forms part of the second drive connection and that gear train includes at least one partial gear wheel having a segment thereof with no gear teeth. A second gear wheel in the train is adapted to engage with the partial gear. Rotation of the outside actuator causes the partial gear to engage the second gear and thereby cause the second drive connection to operate the lock bolt. However, when the inside actuator is rotated the second gear wheel is free to rotate out of engagement with the partial gear. The outside actuator is preferably rotated through 360° in moving the lock bolt between locked and unlocked positions. A slide plate may be used to bias the mechanism into the terminal positions.

15 Claims, 4 Drawing Sheets

LOCK MECHANISM

This invention relates to lock mechanisms of the type used with deadbolt lock assemblies. The invention is particularly concerned with a mechanism for deadbolt assemblies having a pair of rotatable actuators for operating the deadbolt, one on the inside and the other on the outside of a door on which said deadbolt assembly is mounted.

The mechanism of this invention is suitable for use with lock mechanisms of the types disclosed in the specifications, of our co-pending U.S. Pat. Nos. 4,719,774 and 4,724,691 which specifications are incorporated herein by reference. It will however be appreciated that the mechanism disclosed herein may be used with other types of lock mechanisms as well.

With the aforegoing types of deadbolt assemblies the actuators must generally be operable independently of each other, that is, rotation of one actuator to move the deadbolt into the operative or inoperative position must be possible without a key or the like being in position in the other actuator. One mechanism for doing this is having a lost motion connection between the two actuators such that rotation of one actuator will move the deadbolt without causing the other actuator to rotate.

In certain applications it is desirable that at least the outside actuator be rotated through 360° in moving the deadbolt between operative and inoperative positions. One reason for this is because it is important for security reasons that the outside keyhole is in the same orientation whether the deadbolt is in the locked or unlocked condition. It is an object of this invention to provide a mechanism for achieving this operational feature which is easily and efficiently moved in use. A further object of the invention is to provide means for positively locating the deadbolt in either its operative or inoperative position respectively.

Accordingly the invention provides a lock bolt mechanism for mounting to a door or like closure having an inside face and an outside face including, a housing adapted to be mounted to the inside face of said door, a lock bolt mounted on said housing for movement relative thereto, between locked and unlocked terminal positions, an inside actuator rotatably mounted on said housing, a first drive connection between said inside actuator and said lock bolt whereby said bolt is caused to move in response to rotation of said inside actuator, an outside actuator adapted to be accessible from the outside face of said door and adapted to be rotatably mounted on said door or said housing, a second drive connection between said outside actuator and said lock bolt whereby said bolt is caused to move in response to rotation of said outside actuator, a gear train forming part of said second drive connection, said gear train including at least one partial gear wheel having a segment which has no gear teeth, and a second gear wheel for engagement with said partial gear wheel, rotation of said outside actuator causing said partial gear wheel to engage said second gear wheel to move said lock bolt between said terminal positions, said second gear wheel being disengaged from said partial gear wheel when said lock bolt is in either terminal position.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
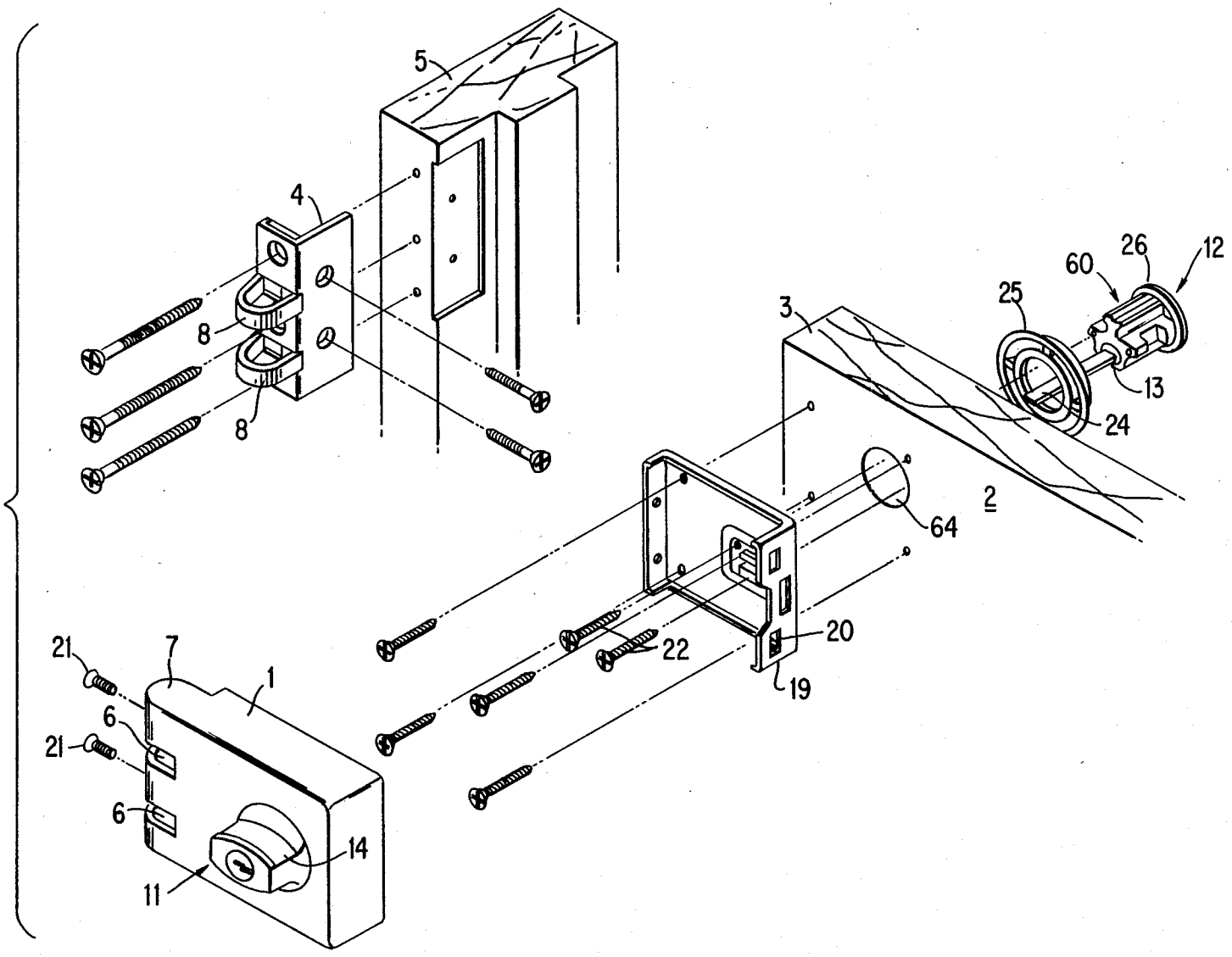
FIG. 1 shows an exploded perspective view of one form of deadbolt assembly to which the invention is applicable.
Figure 2:
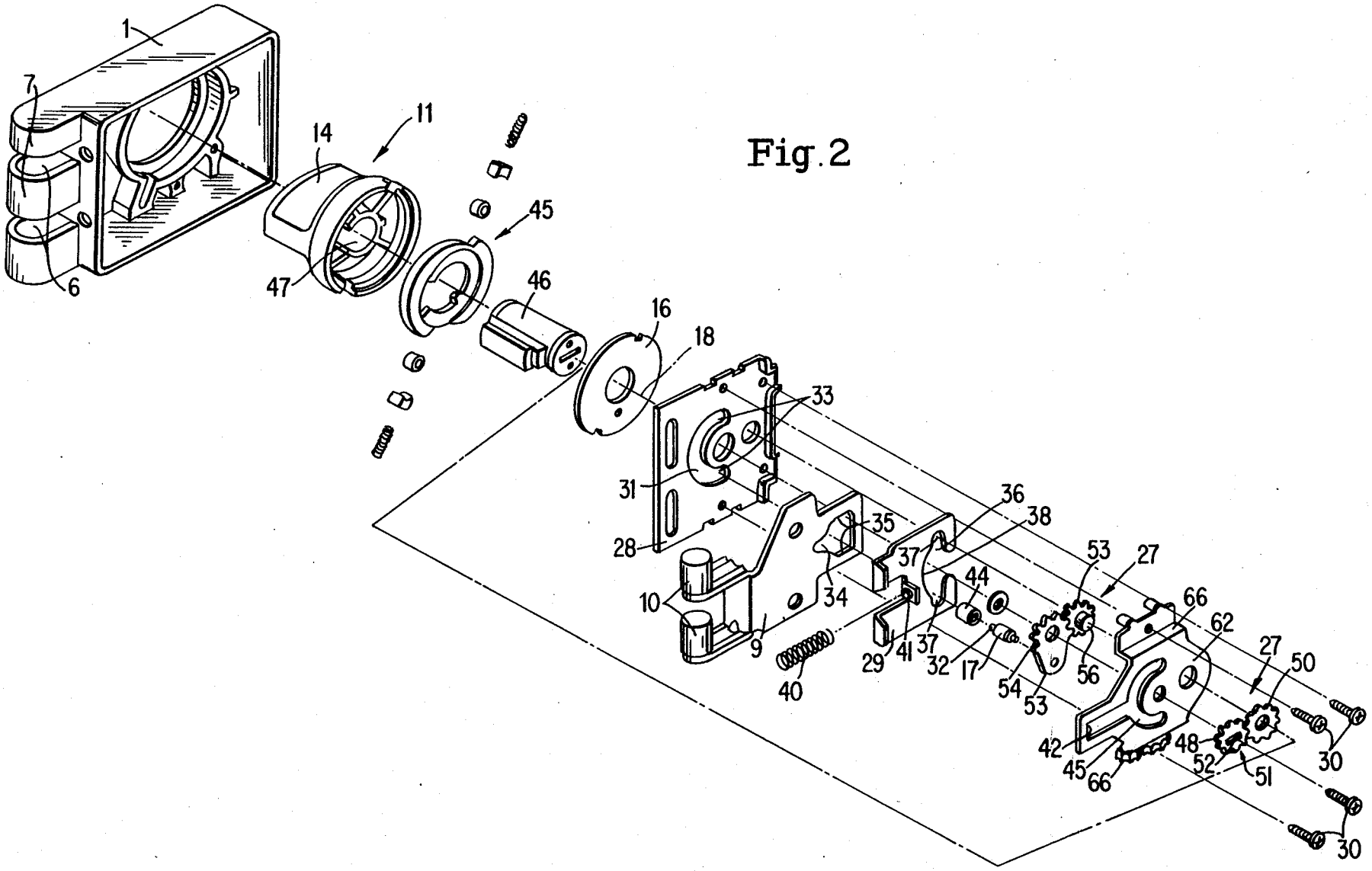
FIG. 2 shows an exploded perspective view of one embodiment of the invention as applied to a deadbolt assembly.
Figure 3:
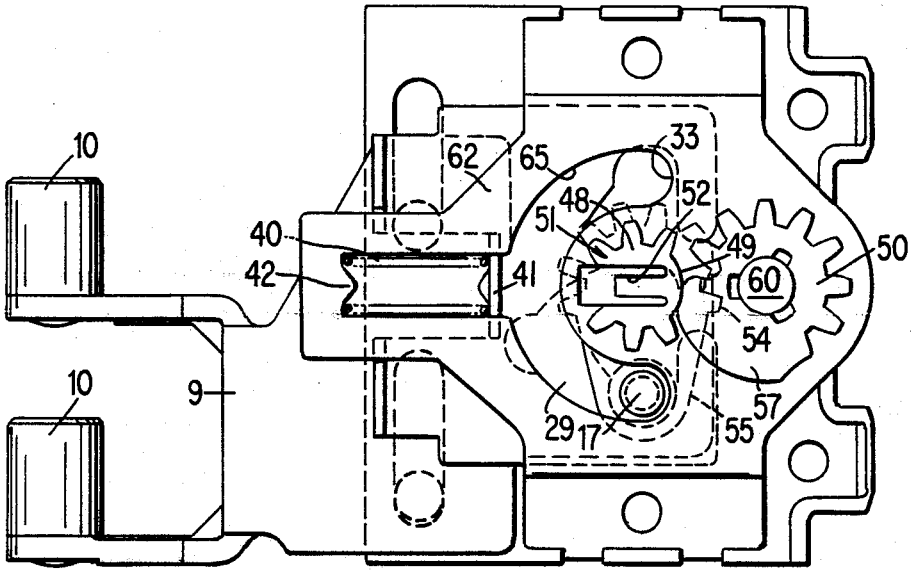
FIG. 3 shows a top plan view of the lock bolt mechanism depicted, in FIG. 2, in assembled condition.
Figure 4:
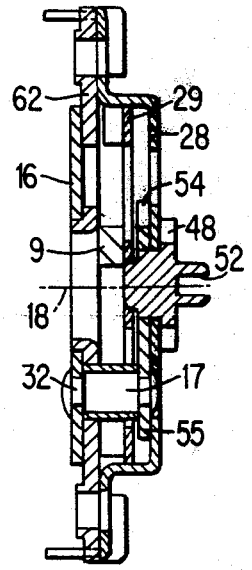
FIG. 4 shows a cross-sectional view along line IV—IV of FIG. 3.
Figure 5:
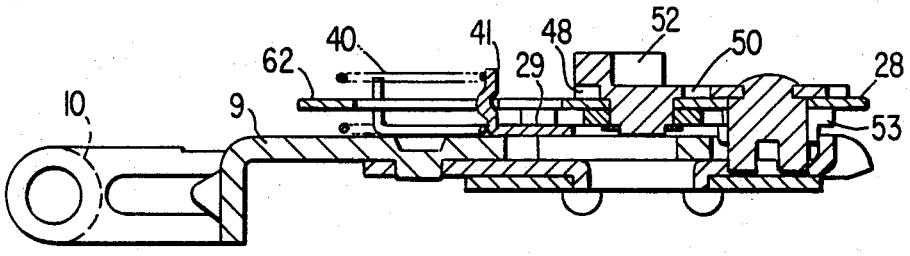
FIG. 5 shows a cross-sectional view along line V—V of FIG. 3.

Referring initially to FIGS. 1 and 2 of the drawings a lock assembly may include a deadbolt housing 1 which in use is secured to the inside face 2 of a door 3, and a strike 4 which in use is secured to a door jamb 5. Two recesses 6 are provided in a projecting end 7 of the housing 1 and each recess 6 is adapted to receive a respective one of the bars 8 of the strike 4. The deadbolt 9, shown in FIG. 2, has two parts 10, each of which extends across a respective one of the recesses 6 in the projecting end 7 of the housing 1 when the deadbolt 9 is in its operative position.

An assembly of the aforegoing kind includes an inside actuator 11 and an outside actuator 12 both of which are used to cause the deadbolt 9 to move into its operative or inoperative positions. The outside actuator 12 is preferably a key operated lock barrel 13, located in a cylinder 60 which will fit into a hole 61 formed in the door 3, whereas the inside actuator 11 may be in the form of a manually operable turn knob 14. In one preferred embodiment of the invention the turn knob 14 is connected to the deadbolt 9 through a drive connection 15 which includes a rotatable plate 16 and a drive pin 17 fixed to the plate 16 so as to move therewith and being located radially outwards from the axis of rotation 18 of the plate 16.

The deadbolt assembly may include a backing plate 19 which in use is secured to the inside face 2 of the door 3 to which the deadbolt assembly is to be mounted. The deadbolt housing 1 may be secured to the backing plate 19 by any convenient means, interlocking formations 20 together with screws 21 being one preferred means of interconnection. The outside actuator 12 may be secured to the backing plate 19 by screws 22 which pass through the backing plate 19 and engage in threaded holes 23 formed in the outside actuator 12. The outside actuator 12 includes a key operated lock barrel 13 and has a bar 24 projecting inwardly from the lock barrel 13 which is used to move the deadbolt 9 on rotation of the barrel 13 in use. The outside cylinder 60 may be located and supported in position on the outside face of the door 3 by an annular shaped mounting plate 25 having a recess for receiving an annular shoulder 26 on the cylinder 60. The outside actuator 12, that is to say the barrel 13, is thus accessible from the outside of the door in a conventional manner.

The bar 24 on the outside actuator 12 is connected to the rotatable plate 16 by means of a gear train 27 which will be more fully described herebelow. Movement of the deadbolt 9 may be guided by a guide plate 28. A support plate 62 is secured to the guide plate 28 and define between them a gap in which said deadbolt 9 and a spring biased slide plate 29 are located. The guide plate 28 and support plate 62 are preferably secured to the housing by screws 30 and the guide plate may include an arcuate slot 31 for guiding the rotational movement of the drive pin 17, one end 32 of which is fixed to the rotatable plate 16. The support plate 62 is provided with shoulders 66 which serve as a guide track for the plate 29.

In moving between respective ends 33 of the arcuate slot 31 the pin 17 causes the deadbolt 9 to move between operative and inoperative positions. The deadbolt 9 preferably has a triangular shaped aperture 34 therethrough in which the drive pin 17 is located. In moving between terminal ends 33 of the arcuate slot 31 in the guide plate 28, the drive pin 17 is caused to bear on one or other of converging sides 35 of the triangular aperture 34 to thereby move the deadbolt.

The spring biased plate 29 preferably serves to positively locate the drive pin 17 in one of the ends 33 of the guide slot 31. With the pin 17 positively located in one of the ends 33, the deadbolt 9 will be located in one of its terminal positions and, likewise, the inside actuator 11 will be fully rotated into one of its terminal positions. The spring biased plate 29 is biased by means of a compression spring 40 which reacts between lug 41 on the spring biased plate 29 and lug 42 on the support plate 62. The direction of bias of the spring biased plate 29 is thus in a direction away from the parts 10 of the deadbolt 9, that is, in a direction to urge the drive pin 17 into the ends 33 of the guide slot 31. In moving the guide pin out of the ends 33 of the guide slot 31, the spring biased plate 29 is moved against the action of the compression spring 40.

Figure 9:
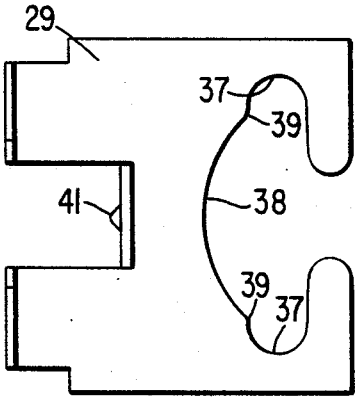
FIG. 9 shows a plate component of the lock mechanism to be biased by a spring.

The spring biased plate 29, shown clearly in FIG. 9, has a substantially oval-shaped opening 36 therein in which pin 17 is situated. That opening has an arcuate edge 38, the radius of curvature of which is the same as that of the guide slot 31. The ends 37 of the oval opening are rounded somewhat so that a shoulder 39 is formed at the junction between each end 37 and the arcuate edge 38. The ends 37 are spaced apart the same distance as the ends 33 in the guide slot 31 so that when the pin 17 is in either terminal position, it will be captively held in that terminal position between the end 37 and the end 33. As the drive plate 16 is rotated and hence the pin 17 is caused to move on its rotational path, the pin 17 presses against the spring biased plate 29, moving the plate 29 against the action of spring 40. When the edge 38 coincides with the slot 31 in guide plate 28, the pin 17 is able to move freely without much resistance being provided by plate 29. The influence of plate 29 is thus greatest towards each end of the rotational arc whilst the pin 17 is still situated in the rounded ends 37 of the plate 29. The support plate 62 also has an arcuate slot 65 but slot 65 serves simply to provide a clearance space for the pin 17.

In one preferred form of the invention the drive pin 17 has a relatively rotatable roller 44 fitted thereto for facilitating movement of the drive pin 17 between its terminal positions. Preferably the rounded ends 37 of the aperture in the spring biased slide plate 29 have a diameter slightly larger than the diameter of this bush 44. Thus, in one of the terminal positions of the drive pin, the roller fits neatly into its respective rounded end 37 thereby positively locating and retaining the drive pin 17 in this terminal position. The spring biased slide plate 29 thus serves to provide spring assisted movement for the inside actuator from an intermediate position to one of its terminal positions.

The inside actuator 11 may be connected to the rotatable Plate through a clutch mechanism 45, and engagement or disengagement of the inside actuator 11 with the rotatable plate 16 may be controlled by a key operated lock 46 which may be mounted in a bore 47 inside actuator 11 to enable to deadbolt 9 to be locked from the inside of the door 3.

One reason why it is desirable for the spring biased plate to positively locate the pin 17 in its terminal positions is to ensure that the inside actuator 11 is also positively located in its terminal positions. The key operated lock 46 will generally be of a type which only allows the insertion and removal of its key when the actuator 11 is in one or other of its terminal positions. The spring biased plate serves to ensure that the rest positions of the inside actuator are in fact one of the terminal positions thereby facilitating the insertion and removal of the key.

Rotational movement of the outside actuator 12 may be transmitted to the drive pin 17 through a gear train 27 which is mounted on the support Plate 62. The gear train 27, which is best seen in FIGS. 3 to 8, includes a first gear wheel 48 which is a Partial gear wheel having a segment 49 in which the gear teeth are removed such that in certain positions of rotation it is out of engagement with a second gear wheel 50 of the gear train 27. The first gear wheel 48 preferably has affixed thereto connection means 51 for engaging the bar 24 of the outside actuator 12, rotation of the outside actuator 12 thus being transmitted to the first gear wheel 48 through the bar 24 and the connection means 51. The connection means 51 may comprise a slot 52 fixed to rotate with the first gear wheel 48, the bar 24 on said outside actuator 12 being of flat strip-like form and locating in slot 52 to rotate the first gear wheel 48 when the outside actuator 12 is rotated. The second gear wheel 50 may be fixed to rotate with a third gear wheel 53, both being fixed to an axle 59 which passes through and is rotatable relative to the support plate 62. The third gear wheel 53 in turn is engaged with a fourth gear wheel 54 which has a laterally extending arm 55. The arm 55 is fixed to the drive pin 17 so that when the fourth gear wheel 54 rotates the arm 55 carries the drive pin 17 along guide slot 31 between the locked and unlocked terminal positions. The second and third gear wheels may be coupled together by means of dogs 56 such that they rotate in unison in use and are mounted for rotation on opposite sides of the support plate 62.

Figure 6:
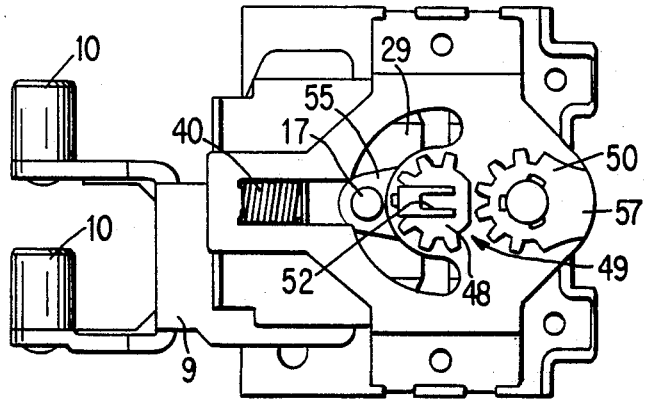
FIGS. 6 to 8 show top plan views of the lock bolt mechanism to that of FIG. 3, but with the mechanism in different operative positions.
Figure 7:
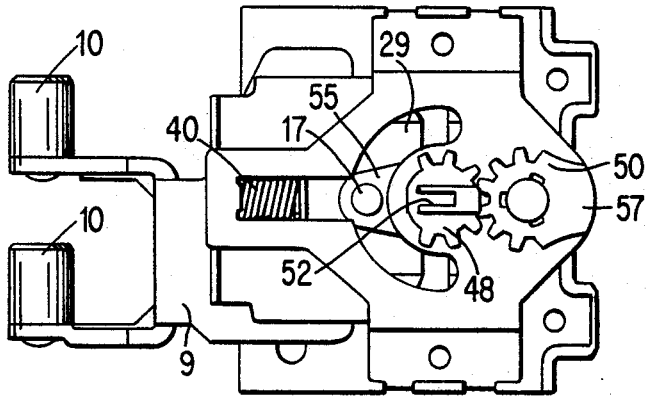

The inside actuator 11 when rotated, will cause the drive pin 17 to move in the arcuate guide slot 31 thereby rotating the fourth gear wheel 54 which, as it is in meshing engagement with the third gear wheel 53, will simultaneously rotate the third and second gear wheels. FIG. 6 shows the position of the first and second gears intermediate the terminal positions of rotation. The teeth of the second gear wheel 50 are able to pass freely in the non-toothed segment 49 of the first gear wheel 48 and, accordingly, there is no link between the inside actuator 11 and the outside actuator 12 when the inside actuator is rotated. The drive pin 17 is only able to move through a rotational arc of 180° as defined by the guide slot 31 in the guide plate 28. The second gear wheel 50 is preferably also a partial gear wheel which has a laterally extending segment 57 which forms a projection which locates in the non-toothed segment 49 in the first gear wheel 48 at each terminal position of rotation. Thus, and this will be noted from FIG. 6, when the inside actuator is rotated a lost motion mechanism results and the second gear wheel 50 is able to rotate without the first gear wheel 48 rotating.

Where it is desired to operate the deadbolt 9 using the outside actuator 12, rotation of the actuator 12 will, through rotation of the operating bar 24, cause the first gear wheel 48 to rotate. On rotation of the first gear wheel 48 the teeth of that gear 48 will be brought into meshing engagement with the teeth of the second gear wheel 50 thereby causing the second gear wheel 50 to rotate and in so doing cause the third and fourth gear wheels 53 and 54 to rotate to drive the drive pin 17 and hence move the deadbolt 9. The first gear wheel 48 will, in rotating between operative and inoperative terminal positions of the deadbolt, rotate through 360°. FIG. 7 shows the position of the first and second gear wheels when the mechanism has been rotated by the outside actuator 12 to an intermediate position.

Figure 8:
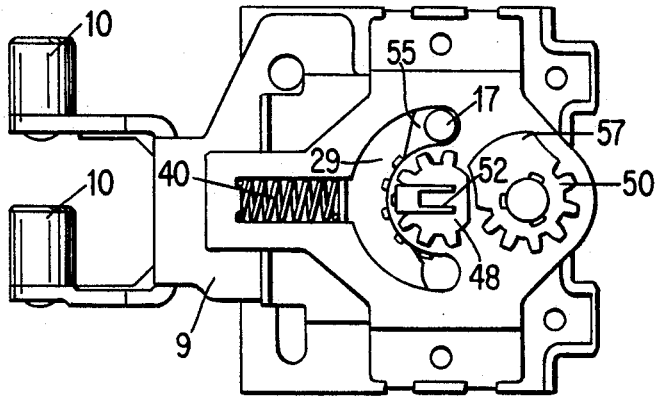

The first gear wheel 48 will be in exactly the same position during both operative and inoperative terminal positions of the deadbolt 9. In each terminal position, the second gear wheel 50 is free to rotate through its rotational arc without engagement with the first gear wheel 48 as, in each case, the teeth of the second partial gear wheel 50 pass freely in the non-toothed segment of the first gear wheel 48. Thus, the inside actuator 11 will always be free to operate the lock mechanism. FIG. 8 shows the position of the first and second gear wheels when the deadbolt 9 is in its locked position.

The outside actuator 12 will not be able to move through more than 360° because the teeth on the first gear wheel 48 will strike against the lateral projection 57 on the second gear wheel 50 thereby preventing further rotation of the first gear wheel 48 beyond 360°.

In a preferred form of the invention the key of the outside actuator 12 is only removeable when the outside actuator 12 is in one of its terminal positions. Thus, it will not be possible to lock the deadbolt mechanism in an intermediate position with the teeth of both the first and second gear wheels 48 and 50 in meshed engagement and the outside key removed from the outside actuator. The key slot (not shown) in the outside actuator 12 will thus be in the same orientation in both the locked and unlocked positions.

The first gear wheel 48 and the fourth gear wheel 54 are coaxially mounted on the axis of rotation 18 of both the inside actuator 11 and the outside actuator 12. The second gear wheel 50 and the third gear wheel 53 are mounted on opposite sides of the support plate 62 and are thus held in position on the support plate 62. The support plate 62 thus Provides a support structure for the gear train 27.

Clearly many different types of gear train assemblies are possible which will provide for lost motion operation and will produce a 180° rotation of the drive pin as a result of a 360° rotation of a partial gear wheel. The particularity of the drawings is therefore not to be understood as superseding the generality of the aforegoing description.

Also, other alterations, modifications and/or additions may be introduced into the constructions and arrangements of parts previously described without departing from the spirit or ambit of the invention.

HAVING NOW described my invention, what I claim as new and desire to secure by Letters Patent is:

1. A lock bolt mechanism for mounting to a door or like closure having an inside face and an outside face including:

a housing adapted to be mounted to the inside face of said door, a lock bolt mounted on said housing for movement relative thereto between locked and unlocked terminal positions, an inside actuator rotatably mounted on said housing, a first drive connection between said inside actuator and said lock bolt whereby said bolt is caused to move in response to rotation of said inside actuator, an outside actuator adapted to be accessible from the outside face of said door and adapted to be rotatably mounted on said door or said housing, a second drive connection between said outside actuator and said lock bolt whereby said bolt is caused to move in response to rotation of said outside actuator, a gear train forming part of said second drive connection, said gear train including at least one partial gear wheel having a segment which has no gear teeth, and a second gear wheel for engagement with said partial gear wheel, rotation of said outside actuator causing said partial gear wheel to engage said second gear wheel to move said lock bolt between said terminal positions, said second gear wheel being disengaged from said partial gear wheel to break said second drive connection when said lock bolt is in either terminal position.

2. A lock bolt mechanism according to claim 1 wherein said outside actuator, in moving said lock bolt between said locked and unlocked terminal positions, is rotated through 360°.

3. A lock bolt mechanism according to claim 2 wherein said outside actuator includes a key operated lock cylinder and a key for said lock cylinder is only able to be inserted into said cylinder, and removed therefrom, when said lock bolt is in either of its terminal positions.

4. A lock bolt mechanism according to claim 1, wherein said first drive connection includes a rotatable drive plate, and a Pin fixed to rotate with said drive plate, said pin being secured to said drive plate at a position radially outwards from the axis of rotation of said drive plate, said pin also being secured to a final gear wheel in said gear train at a position radially outwards from the axis of rotation of said final gear wheel, rotation of said inside actuator being operable to rotate said drive plate and hence said pin and said final gear wheel, but said second drive connection remaining broken during rotation of said inside actuator.

5. A lock bolt mechanism according to claim 1, wherein said drive chain includes at least first, second and final gear wheels, said first gear wheel being a partial gear wheel and arranged to be connected to said outside actuator, said final gear wheel being connected to said lock bolt to move therewith in use, and said second gear wheel serves to link said first gear wheel with said final gear wheel.

6. A lock bolt mechanism according to claim 5 wherein the axes of rotation of said first gear wheel and said final gear wheel, and said inside actuator and said outside actuator are all coincident.

7. A lock bolt mechanism according to claim 1 wherein said gear train comprises first, second, third and final gear wheels and is mounted to a support plate which is fixed to said housing, said first and second gear wheels being mounted on one face of said support plate and said third and fourth gear wheels being mounted on the other face of said support plate, said second and third gear wheels being mounted on a common axle which passes through said support plate, each of said second and third gear wheels being fixed to rotate with said axle, and said axle being rotatable relative to said support plate.

8. A lock bolt mechanism according to claim 1 wherein said housing is hollow and has a front wall and an open back, a circular opening formed through said front wall, and said inside actuator includes a hand engageable part which is rotatably located in said circular opening and projects forwardly of said front wall and a mounting part which abuts against a rearwardly facing surface of said front wall.

9. A lock bolt mechanism according to claim 1, wherein said second gear wheel has a lateral projection thereon and the gear teeth of said first gear wheel will strike said lateral projection to prevent rotation of said first gear wheel beyond 360° rotation after moving said lock bolt from locked to unlocked terminal positions or from unlocked to locked terminal Positions.

10. A lock bolt mechanism according to claim 4, wherein a biasing spring is supported on said housing and said spring acts to urge said pin into one or other of said terminal positions.

11. A lock bolt mechanism according to claim 10, wherein a slide plate is slidably supported on said housing and said biasing spring acts between said housing and said slide plate, an edge of said slide plate contacting said pin to urge said pin into said terminal positions.

12. A deadbolt assembly including, a housing, a deadbolt mounted on said housing for linear movement relative thereto between operative and inoperative positions, an actuator mounted on said housing, a drive plate rotatably mounted on said housing and being connected to said housing so as to rotate in response to operation of said actuator between terminal positions which correspond to said operative and inoperative positions of said lock bolt, a drive pin fixed to said drive plate so as to move therewith and being located radially outwards from the axis of said plate rotation, means on said deadbolt cooperating with said pin so that said pin is adapted to push against said deadbolt and thereby cause said linear movement as said drive plate is rotated, a slide plate slidably mounted on said housing and having an edge thereof in contact with said pin, and a spring acting between said housing and said slide plate to urge said slide plate against said pin to bias said pin so that said drive plate is urged into one or other of its terminal positions.

13. A deadbolt assembly according to claim 12, wherein said slide plate slides in a linear direction which is substantially perpendicular to the linear direction in which said deadbolt moves.

14. A deadbolt assembly according to claim 12, wherein said edge is an arcuate edge and the radius of curvature of said arcuate edge is the same as the radius of the path on which said pin travels.

15. A deadbolt assembly according to claim 12, wherein a guide Plate is mounted on said housing, said guide plate having an arcuate slot therein in which said pin travels, said arcuate slot having ends and said ends defining the terminal positions of rotation of said drive plate, said slide plate urging said drive pin into said ends.

* * * * *